US005709462A

United States Patent [19]

Rumpel

[11] Patent Number: 5,709,462

[45] Date of Patent: Jan. 20, 1998

[54] MOUNTING FOR CONVENTIONAL DECORATIVE LIGHT STRINGS

[76] Inventor: Donald D. Rumpel, HC-1 Box 216, Kellogg, Id. 83837

[21] Appl. No.: 785,854

[22] Filed: Jan. 21, 1997

[51] Int. Cl.[6] ..... F21V 33/00

[52] U.S. Cl. ..... 362/249; 362/252; 362/396; 362/103; 362/237; 362/363

[58] Field of Search ..... 362/249, 252, 362/103, 806, 808, 396, 237, 363, 311, 353, 310

[56] References Cited

U.S. PATENT DOCUMENTS

| | | | |
|---|---|---|---|
| 2,220,516 | 11/1940 | Foute . | |
| 3,511,982 | 5/1970 | Salter . | |
| 4,507,718 | 3/1985 | Bury | 362/396 |
| 4,547,840 | 10/1985 | Tinder | 362/226 |
| 4,679,126 | 7/1987 | Van Sickler | 362/226 |
| 5,184,890 | 2/1993 | Chen | 362/353 |
| 5,192,127 | 3/1993 | Schaef | 362/226 |
| 5,278,734 | 1/1994 | Ferber | 362/103 |
| 5,338,585 | 8/1994 | Fraus | 428/18 |
| 5,361,192 | 11/1994 | Lai | 362/123 |
| 5,481,444 | 1/1996 | Schultz | 362/249 |
| 5,517,394 | 5/1996 | Lin | 362/353 |
| 5,519,595 | 5/1996 | Wang | 362/808 |
| 5,534,315 | 7/1996 | Witte | 362/808 |
| 5,613,764 | 3/1997 | O'Brien | 362/808 |
| 5,624,181 | 4/1997 | Miller et al. | 362/103 |

*Primary Examiner*—Thomas M. Sember
*Attorney, Agent, or Firm*—Wells, St. John, Roberts, Gregory & Matkin P.S.

[57] ABSTRACT

A silhouette display and lighting clip arrangement is described for mounting conventional decorative string lights. A flexible open mesh sheet is included, with spaced interstices extending between a front and a back side of the sheet. A light clip base member and a transparent lens member having a bulb receiving recess are also included for attachment to the sheet. One of the members includes a fastener configured to releasably secure a decorative light bulb and socket with the light bulb received within the bulb receiving recess. The fastener is shaped to releasably join the light clip base member and transparent lens member on opposed sides of the open mesh sheet through the open mesh of the sheet with the transparent lens member projecting from the front side of the sheet. A process is also disclosed for producing the light display for use with conventional decorative string lights.

15 Claims, 5 Drawing Sheets

MOUNTING FOR CONVENTIONAL DECORATIVE LIGHT STRINGS

TECHNICAL FIELD

The present invention relates to mounting conventional decorative light bulbs and sockets in a display.

BACKGROUND OF THE INVENTION

The use of single and multiple strings of decorative lights is growing constantly in popularity, especially for commemorating festive occasions. Christmas lights, for example are used both commercially and in private homes to promote the festive mood of the Christmas holiday season. The same light strings are also finding increasing usage for decorative display for other purposes. The light bulbs and sockets are widely available and may be purchased in numerous sizes and numbers in single and multiple strands for such display purposes. The light strings are flexible and can easily be hung or draped over objects in desired configurations. Artistic individuals will hang or drape the decorative light strings in prescribed patterns to designate or form the outline of particular object. However, this is often a frustrating experience since it is difficult to determine the appearance of the desired pattern by estimating the number, spacing, and coloration of lights used to outline or define the object to be displayed.

As a solution to the problem, various multi-dimensional forms have been produced for mounting the decorative light strings in predetermined configurations. While such forms are useful and eliminate much of the frustration in selecting proper placement of the lights, the forms themselves are quite bulky and take up an undesirable amount of storage space when they are not in use. Thus a problem remains.

An object of the present invention is to provide a decorative lighting display that can be easily stored when not in use, and that lends itself well to a variety of display configurations.

The above and other objects and advantages will become evident upon reading the following description of preferred forms of my invention.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
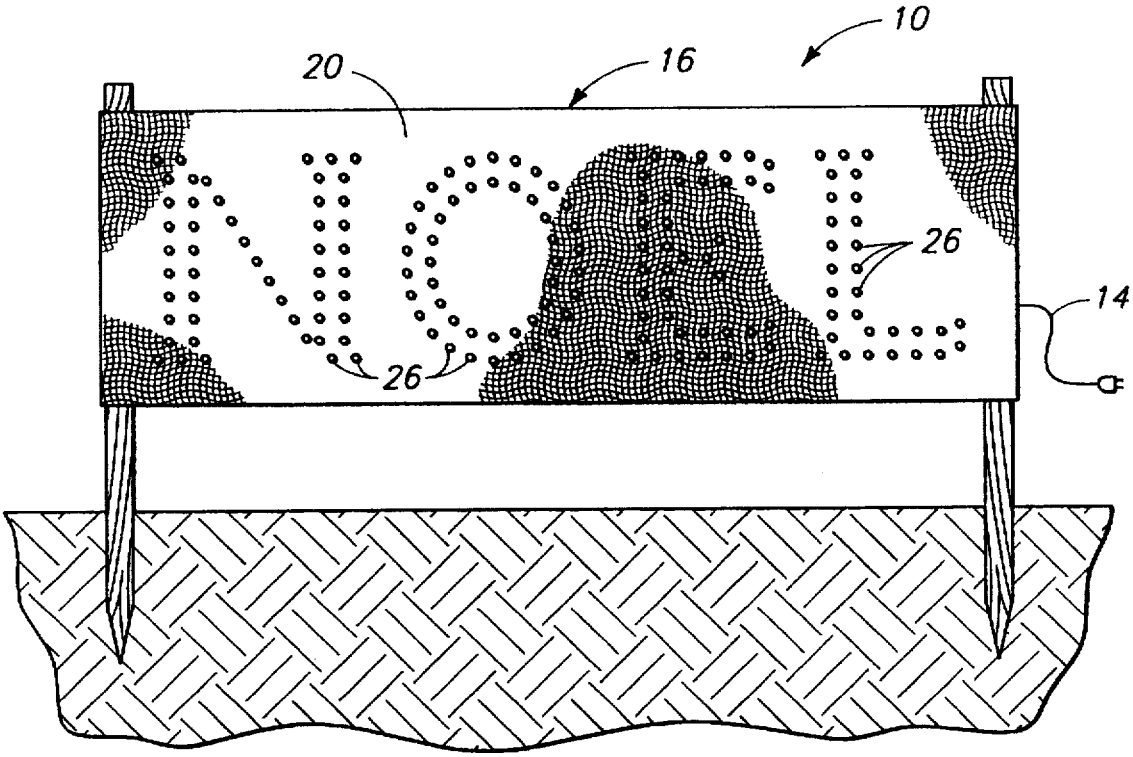
FIG. 1 is a diagrammatic view of a display making use of a preferred form of the present invention.
Figure 2:
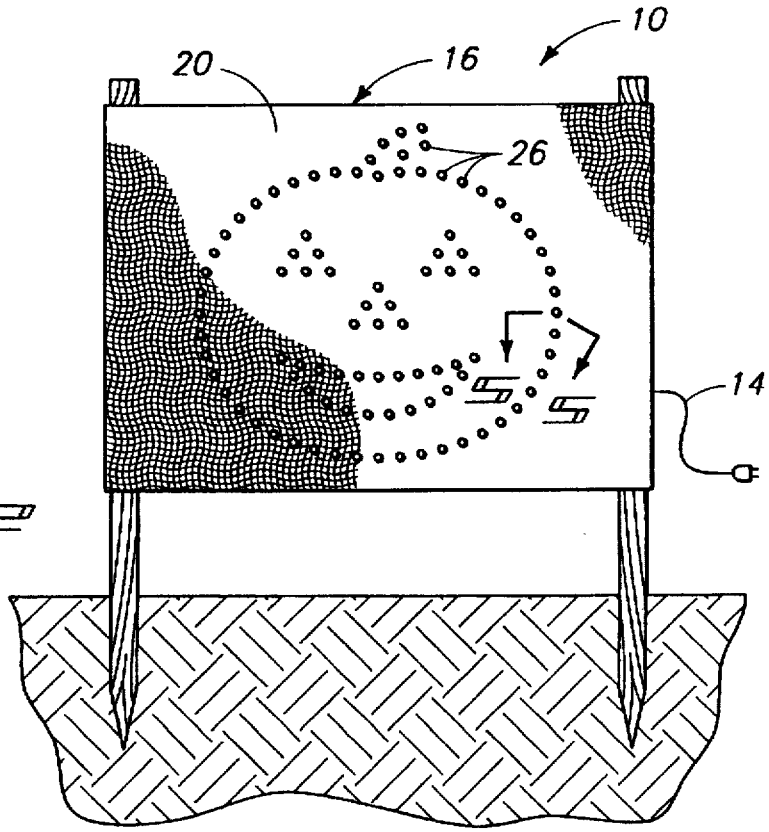
FIG. 2 is a view similar to FIG. 1 only showing a different display.

A mount for conventional decorative string lights is generally shown in the drawings and is designated therein by the reference numeral 10. One exemplary form of the mount is shown in FIG. 1, and another is shown in FIG. 2 to clearly indicate the versatility of the mount 10 for use in forming a variety of display configurations.

Figure 3:
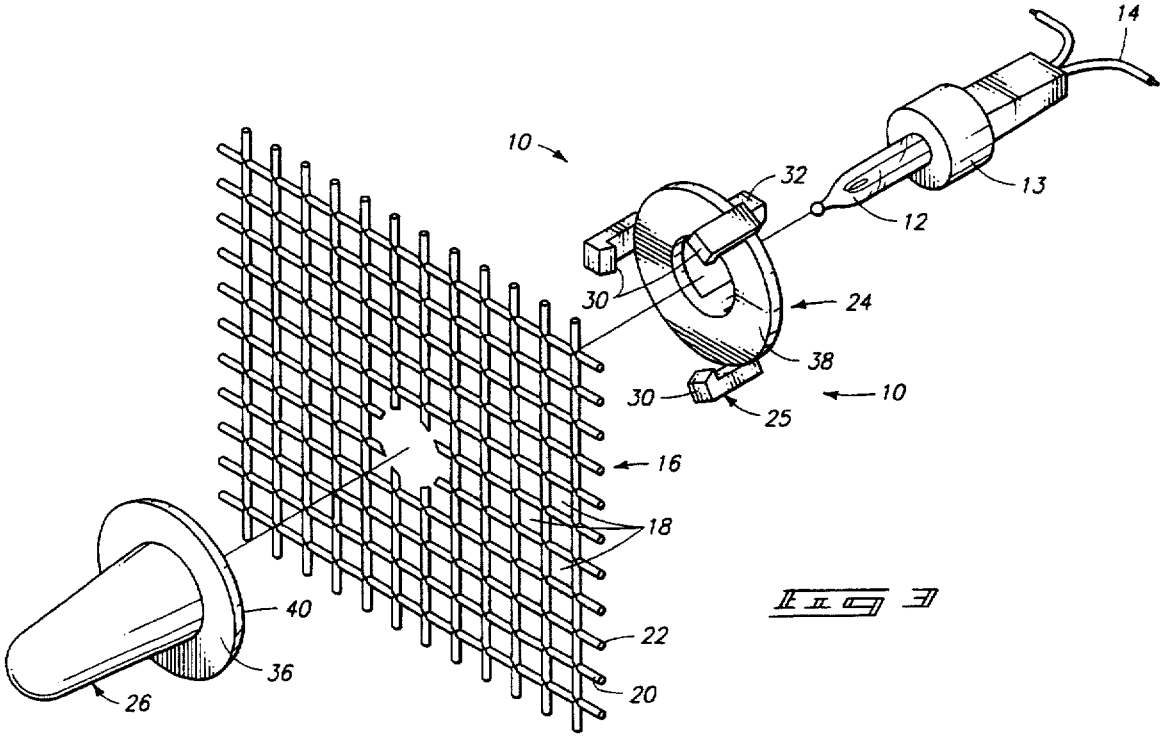
FIG. 3 is an exploded perspective view of individual components used in a preferred form of the present invention.
Figure 4:
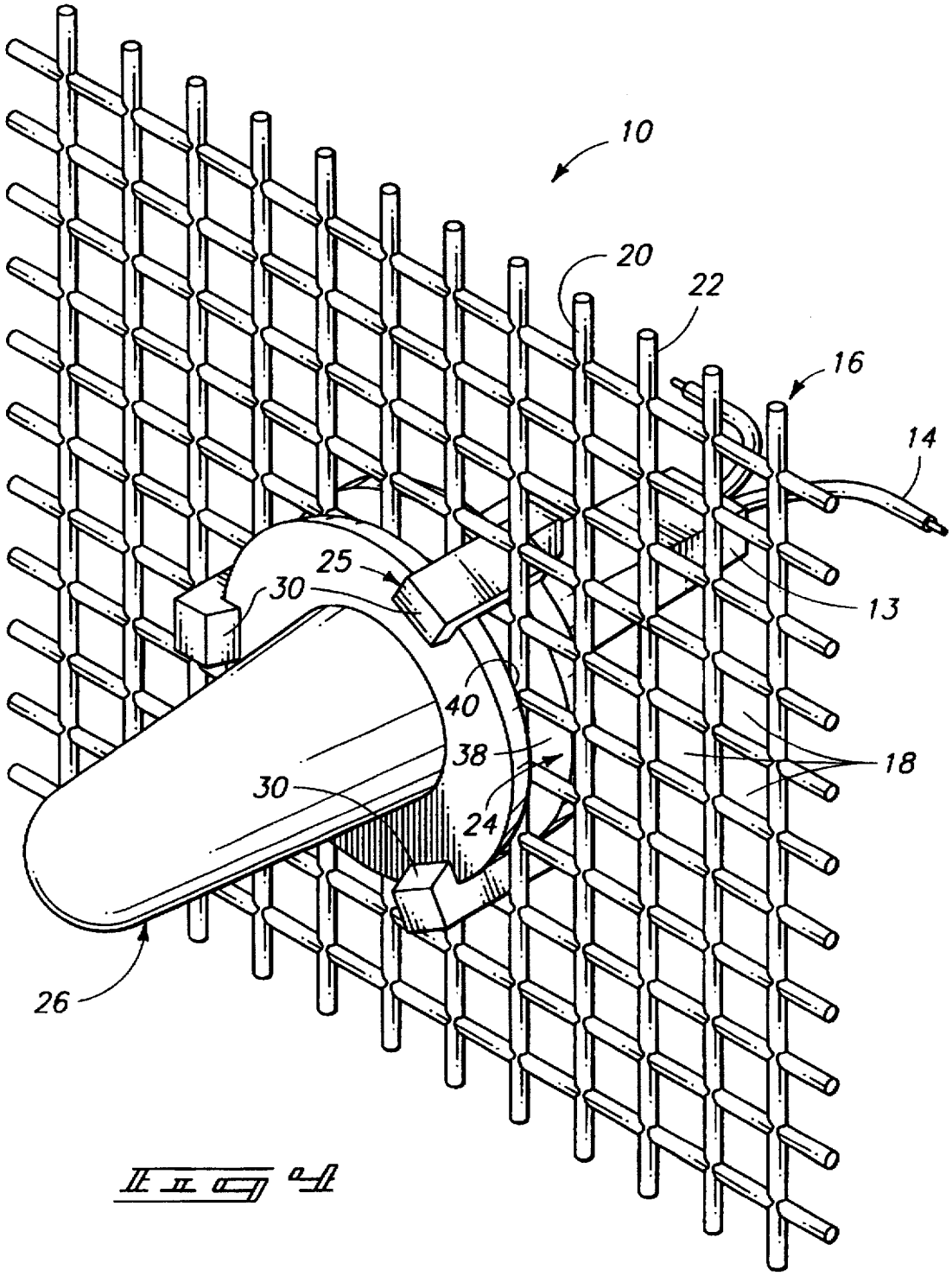
FIG. 4 is a view similar to FIG. 3 only showing the components assembled.
Figure 5:
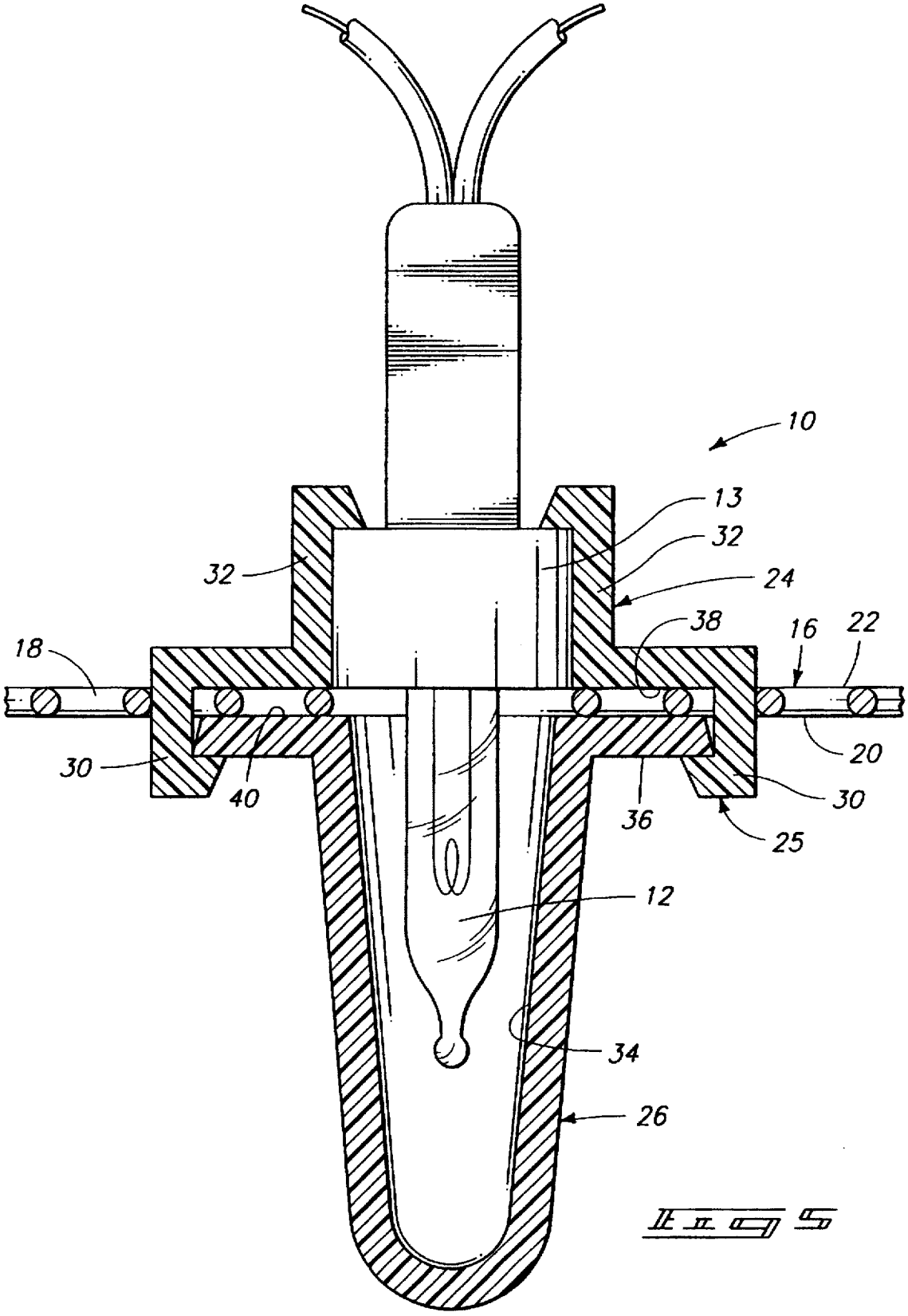
FIG. 5 is an enlarged sectional view taken substantially along line 5—5 in FIG. 2.
Figure 6:
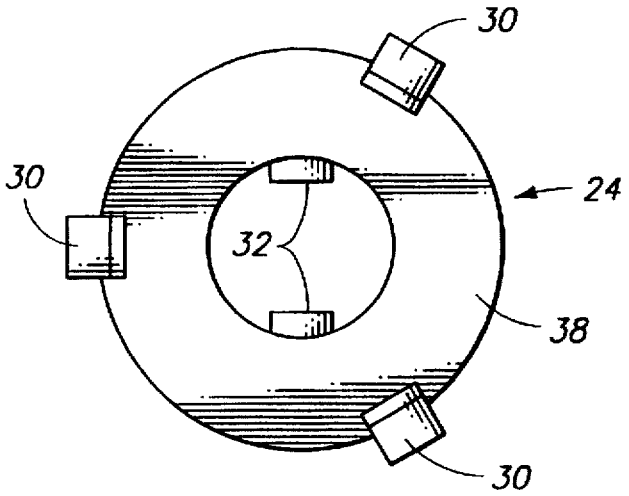
FIG. 6 is an end elevation view of a base member of a preferred form.
Figure 7:
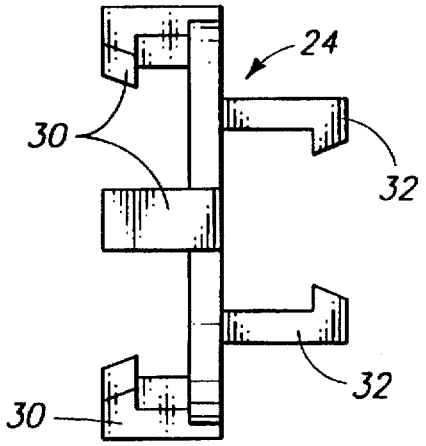
FIG. 7 is a side elevation view of the preferred base member.
Figure 8:
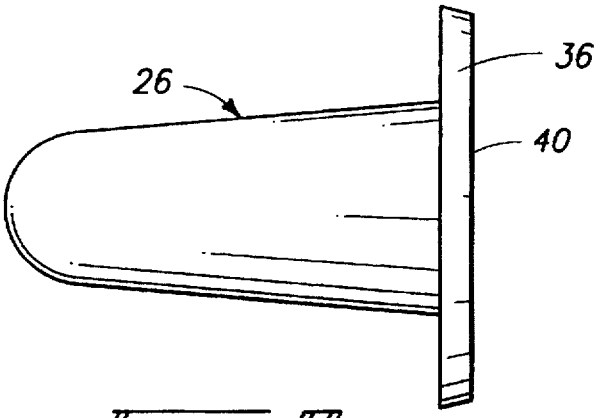
FIG. 8 is a side elevation view of a transparent lens member of a preferred form.
Figure 9:
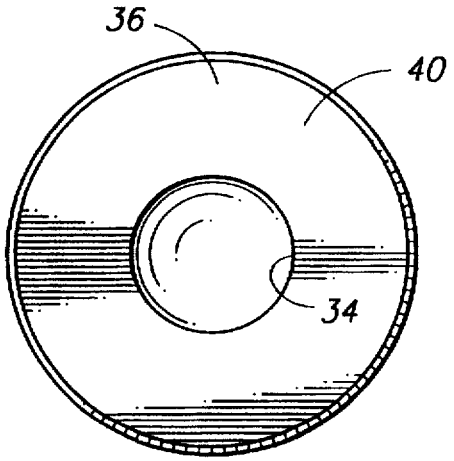
FIG. 9 is an end elevation view of the transparent lens member of FIG. 8.

In all forms, the mount and process is to be used with existing, conventional strings of decorative lights, commonly known as Christmas lights, including a plurality of socket mounted light bulbs 12 and electrical wire 14 extending between consecutive light bulb sockets 13, one example of which is shown in FIGS. 3–5.

The exemplified decorative lights are a standard miniature scale, but other conventional decorative light string forms could also be used. Obvious dimensional modifications may be made to the structure disclosed below to accommodate various conventional bulb and socket sizes.

A preferred flexible open mesh sheet 16 is shown in FIGS. 1–5. In a preferred form the open mesh sheet 16 is formed of flexible material, most preferably a plastic covered or impregnated netting. One example of a preferred open mesh sheet 16 is a vinyl coated mesh of approximately 9×4 intersecting threads per inch, manufactured by Bruin Plastics of Glendale, R.I., 02826.

The preferred sheet 16 is flexible and includes spaced interstices 18 that extend through the sheet 16 and open along front and back sheet side surfaces 20, 22 respectively. It is noted from viewing FIGS. 1 and 2 that various sizes of sheets 16 may be used. It should also be understood that the sheets 16 may be produced in various shapes according to the shape of the object or form to be displayed.

The nature of the sheet 16, being formed of open mesh, leads to several advantages to the user, and to those marketing the product. Firstly, the open mesh material is a strong, lightweight and readily available material that can be produced in a variety of mesh sizes and sheet dimensions. Also, the flexible nature of the sheet material will permit folding or rolling of the sheet 16 for storage or shipping, thereby minimizing packaging size and storage space. Further the open mesh allows the complete display to be exhibited in windy outdoor situations, where the force of even low velocity wind would damage a similar size display. The nature of the sheet material also permits a variety of mounting arrangements, one of which is shown in FIGS. 1 and 2, where stakes driven into the ground surface are used to secure the sheets in position for display. Other mounting arrangements can also be easily visualized. For example the sheets could be affixed to the side of a building or other structure, or suspended inside or outside a window. Other mounting configurations may also become evident with use of the display.

The open mesh permits a great degree of latitude in manufacturing, since the open nature of the mesh will allow a production worker to see a pattern clearly beneath the mesh, and the mesh openings facilitate ease in mounting the light clip base members and lens members that are to be described in greater detail below. A still further advantage is that the mesh material can be colored or printed using substantially conventional methods if coloration or printing is desired to supplement the decorative lighting applied to the sheets.

Also included with a preferred form of the present invention is a light clip base member 24. The base member 24 cooperates with a transparent lens member 26, and the two members together are mountable to the sheet 16 and will releasably mount one of the light bulbs 12 and associated socket 13.

The base member 24 is preferably formed of injection molded plastic and is transparent or translucent to facilitate assembly. It is not necessary that the base be light transmissive, since the base members 24 will be mounted to the back side of the sheet 16 and most probably will not be clearly visible or constitute part of the display to be exhibited to viewers. The transparent bases allow assemblers to see through the bases during assembly and will thereby facilitate assembly. It is preferred that the base members 24 be formed of a polycarbonate plastic material that is readily injection molded.

The preferred base member 24 as shown in FIGS. 3-7 includes a ring shaped or torroidal base part 28. The base part 28 includes a central opening that will readily receive a light bulb 12, which will project through the opening and into the lens member 26 as shown in FIG. 5. The opening in the base part 28 is made to align with a prepared hole in the sheet 16.

In an alternate form, the sheet 16 is provided only with base members 24, without lens members 26 to provide receptacles for the lights 12. In this arrangement the lights themselves provide the selected coloration, since decorative lights are conventionally produced in a wide selection of colors. However the preferred combination described below includes both the base members 24 and the lens members 26 with the coloration of the display provided by the lens members.

A fastener generally indicated at 25 is configured to releasably secure the decorative light bulb 12, and base members to the sheet. Preferably the fastener 25 is also capable of securing the light bulb within the transparent lens member 26 (preferably a bulb receiving recess in the member 26, which will be described in greater detail below). In the most preferred form the fastener is shaped to releasably join the light clip base member and transparent lens member on opposed sides of the open mesh sheet 16 through the open mesh of the sheet 16 with the transparent lens member 26 projecting from the front side 20 of the sheet 16.

In as a general consideration, the fastener could be part of either member 24, 26, be separate from both members, or be provided on only one of the members. The presently preferred base member 24 exemplified herein will include the fastener 25 in the form of two oppositely projecting sets of prongs 30, 32 integrated with the base member. The first set of prongs 30 are arranged angularly about the base part 28 and are barbed at outward ends to extend through the sheet 16 and clip onto the lens member 26. The second set of prongs 32 extend rearwardly to engage and hold a light socket 13 as shown in section by FIG. 5.

It is preferred that three prongs 30 of the first set be used to secure the lens member 26 and eliminate any reasonable possibility that the lens member will slip sideways from the grip of the prongs 30. The length of the prongs 30 from the base part 28 to the barbed ends is sufficient to accommodate the thickness of the sheet 16 and the thickness of the engaged part of the lens 26. This feature is clearly shown by FIG. 5.

It is also preferred that the prongs 32 of the second set be spaced apart by a distance slightly greater than the diameter of the light socket 13. The socket 13 will thus be received between the prongs 32 and the barbed ends will engage (if not snap over) the socket and hold the socket 13 firmly but releasably to the base member and the sheet 16. It is understood that not all light sockets have similar dimensions, and that the barbed ends of the prongs 32 will not be of sufficient length to snap over all forms of light sockets. However, the preferred prongs 32 are flexible and resilient, and will spring apart but grip practically any known form of light socket for miniature decorative lights.

The transparent lens member 26 briefly disclosed above is cup shaped, with a bulb receiving recess 34 formed therein to receive the light bulb 12. The size and shape of the recess 34 may vary according to the light bulbs 12 being used, but preferably closely resembles the external shape of the bulbs 12 being used. Likewise the external surface of the lens members 26 may be of any selected shape.

The transparent lens members 26 may be produced in different colors according to the display to be produced. For example, the lens members 26 defining the letters in the display shown in FIG. 1 may all be the same color, or each letter may be formed of a different color. Any combination is possible, with the lens members 26 determining the ultimate color of the display.

With the above arrangement it is preferred that the light bulbs 12 be clear of color, so the display color will be determined only by the color of the selected lens members 26. Thus the ultimate user need not take care to arrange bulbs with particular colors at desired locations since the color arrangement may be previously arranged by selection of lens member colors during assembly of the display. Further the user need only stock one color (clear) light bulb since the color in the display comes only from the colored lens members 26.

In each lens member 26, the recess 34 is open at a flanged end 36. The flange is preferably slightly beveled at its outer edge to cam against the barbed ends of the prongs 30, urging them outwardly before snapping over the flange surface as shown in FIG. 5. The flange is also preferably circular, but could as easily take other configurations as long as surface is provided for engagement by the prong barbs.

The lens members are preferably formed of injection molded plastic that is transparent and easily colored. High density, high impact polystyrene is a preferred material due to its ability to accept coloration.

It is noted that each of the preferred base and lens members 24, 26 include opposed sheet engagement surfaces 38, 40. The surface 38 is provided on base member 24 is flat for flush engagement against the back side 22 of the sheet. The surface 40 of the lens member is provided on the flanged end 36 and is flat for flush engagement against the front side 20 of the sheet, opposite the surface 38. Thus, when the fastener 25 is engaged, the surfaces 38, 40 are held together and sandwich the sheet to secure the lens member to the sheet with the transparent lens member projecting to the front side of the sheet, and with the base member and fastener positioned on the back side of the sheet to receive and mount a conventional decorative light bulb and socket.

The above components lend themselves well to formation of any selected display in which numerous decorative lights are to be used to accentuate the display. The following discussion will exemplify a process for producing a light display for mounting a string of conventional decorative light bulbs and sockets. In general, the process includes the following steps, it being noted that the steps described below are not necessarily in any prescribed order.

One step in the preferred process involves providing light the clip base members 24. As discussed above, this step may be accomplished by injection molding using selected plastic materials.

Another step, not necessarily in order with the step above, is to provide the open mesh sheet. Sheets with open mesh weave are commercially available and can often be purchased in rolls. The individual sheet may thus be cut from a roll. Now the desired pattern for the lights is determined and is transferred in some appropriate manner to the sheet. In a prototype, the pattern was transmitted to a sheet first by drawing the pattern on a sheet of plywood, then the locations for the various lens members were located and marked on the plywood form. Holes were drilled in the plywood at the selected locations and the sheet was placed over the holes. A hole cutter was then used to cut holes in the sheet at the same locations as the holes in the underlying plywood. The holes then defined the pattern on the sheet and indicated the location for placement of the base and lens members 24, 26.

A further step in the present process involves securing the base members 24 to the sheet in an order defining a prescribed design on the sheet. This step is accomplished by plunging the prongs 30 of the base members through the sheet, preferably from the back side. The outline of the design is thus formed on the sheet as defined by the attached base members. This may also be the final step in completing the sheet for reception of decorative lights, and the lights may be secured by the user (as opposed to the manufacturer) to the applied base members 26 through the back side of the sheet with the electrical cord also draped along the back side so as not to be visible from the front. Only the light bulbs will be visible from the sheet front and, when illuminated, will produce a lighted outline of the prescribed design.

In another step of the most preferred process, the transparent lens members 26 are provided. This step is preferably accomplished by injection molding, preferably using the plastic materials disclosed above. Conventional injection molding processes may be used for accomplishing this step and the step of providing the base members 24.

A successive step then is that of releasably securing the base members and transparent lens members together. This step is preferably accomplished by providing barbed prongs on one of the members, and engaging the barbed prongs of the one member with the other member, on opposite sides of the open mesh sheet 16. The sheet is thus sandwiched between the interconnected members and the members are secured together by operation of the fastener. Numerous sets of lens members and base members may be thus assembled on the sheet, preferably with the lens members projecting from the front of the sheet, and the base members secured against the back of the sheet. The numbers of lens members and base members, and the spacing between the interconnected members on the open mesh sheet may vary according to the design to be illuminated. Also the colors of the lens members can be selected according to the prescribed design.

The lens members are attached simply by forcing the base flange parts of the lens members between the prongs 30 from the front side of the sheet. This secures the lens members and base members to the sheet and provides selectively colored lens members according to the design desired. The assembler merely selects lens members that are colored according to the selected design and attaches them to the base members as indicated above.

This completes the assembly of the display which is now ready to receive decorative lights. This step may also be the final step completed during manufacture before the display is readied for shipping to a wholesaler, retailer, or directly to the ultimate user.

A final next step (which may be performed by the manufacturer or the ultimate user) involves securing a string of conventional decorative light bulbs and sockets to the base members and transparent lens members from a side 20 of the sheet opposite the one side 22.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A silhouette display and lighting clip arrangement for mounting conventional decorative string lights having socket mounted light bulbs and electrical wire extending between consecutive light bulb sockets, comprising:

a flexible open mesh sheet including spaced interstices and including a front and a back side;

a light clip base member;

a transparent lens member having a bulb receiving recess therein;

a fastener configured to releasably secure a decorative light bulb and socket with the light bulb received within the bulb receiving recess; and wherein the fastener is shaped to releasably join the light clip base member and transparent lens member on opposed sides of the open mesh sheet through the open mesh of the sheet with the transparent lens member projecting from the front side of the sheet.

2. A silhouette display and lighting clip arrangement for reception of string lights having socket mounted light bulbs and electrical wire extending between consecutive light bulbs, as claimed by claim 1 wherein the fastener is comprised of a set of barbed prongs on one of the members and spaced apart thereon to be received through the open mesh of the sheet and to engage and secure the other of the members.

3. A silhouette display and lighting clip arrangement for reception of string lights having socket mounted light bulbs and electrical wire extending between consecutive light bulbs, as claimed by claim 1 wherein the fastener is comprised of two sets of prongs, including a first set interconnecting-the members on opposed sides of the open mesh sheet through the open mesh thereof, and a second set projecting rearwardly of the back side and positioned to receive and secure a light socket with a decorative light bulb in the socket received within the bulb receiving recess.

4. A silhouette display and lighting clip arrangement for reception of string lights having socket mounted light bulbs and electrical wire extending between consecutive light bulbs, as claimed by claim 1 wherein the flexible open mesh sheet includes a plurality of interconnected light clip base members and transparent lens members arranged on the sheet in a selected pattern.

5. A light clip for mounting a conventional decorative light bulb and socket to a sheet, comprising:

a light clip base member;

a transparent lens member having a bulb receiving recess therein;

a fastener configured to releasably secure a conventional decorative light bulb and socket with the light bulb received within the bulb receiving recess;

wherein the base and lens members include opposed sheet engagement surfaces configured to abut and be clamped against a sheet to secure the lens member to the sheet with the transparent lens member projecting to one side of the sheet, and with the base member and fastener positioned to receive and mount the conventional light bulb and socket from an opposite side of the sheet.

6. A light clip for mounting a conventional decorative light bulb and socket to a sheet as claimed by claim 5, wherein the fastener is comprised of a set of barbed prongs on one of the members and spaced apart thereon to penetrate a sheet and to engage and secure the other of the members.

7. A process for producing a light display for mounting a string of conventional decorative light bulbs and sockets, comprising the steps of:

providing light clip base members;

providing transparent lens members for each of the light clip base members, the transparent lens members each having a bulb receiving recesses therein; and releasably securing the base members and transparent lens members together on opposed sides of a sheet with the transparent lens members projecting to one side of the sheet in positions to receive the decorative light bulbs.

8. A process as claimed by claim 7 including the further step of securing a string of conventional decorative light bulbs and sockets to the base members and transparent lens members from a side of the sheet opposite the one side.

9. A process as claimed by claim 7 wherein the step of releasably securing the base members and transparent lens members together is accomplished by:

providing barbed prongs on one of the members, and engaging the barbed prongs of the one member with the other member.

10. A process as claimed by claim 7 wherein the step of releasably securing the base members and transparent lens members together is accomplished by:

providing prongs on the one of the members;

extending the prongs of the one member through the sheet; and engaging the prongs with the other member to thereby secure the members together on the sheet.

11. A process as claimed by claim 7 wherein the step of releasably securing the base members and transparent lens members together is accomplished by:

providing prongs on the base member;

extending the prongs of the base member through the sheet; and engaging the prongs with the transparent lens member.

12. A display and lighting clip arrangement for mounting conventional decorative string lights having socket mounted light bulbs and electrical wire extending between consecutive light bulb sockets, comprising:

a flexible open mesh sheet including spaced interstices and including a front and a back side;

a light clip base member; and a fastener configured to releasably secure the base member to the open mesh sheet and configured to releasably mount a decorative light bulb and socket with the light bulb projecting from the front side of the flexible open mesh sheet.

13. A display and lighting clip arrangement for reception of conventional decorative string lights having socket mounted light bulbs and electrical wire extending between consecutive light bulbs, as claimed by claim 12 wherein the fastener is comprised of a set of prongs on the base member and attachable to the flexible open mesh sheet through the interstices thereof.

14. A silhouette display and lighting clip arrangement for reception of conventional decorative string lights having socket mounted light bulbs and electrical wire extending between consecutive light bulbs, as claimed by claim 12 wherein the fastener is comprised of a set of flexible barbed prongs on the base member and spaced apart thereon to be received through the spaced interstices of the flexible open mesh sheet and releasably secure the base member to the flexible open mesh sheet.

15. A silhouette display and lighting clip arrangement for reception of conventional decorative string lights having socket mounted light bulbs and electrical wire extending between consecutive light bulbs, as claimed by claim 12 wherein the fastener is comprised of two sets of prongs on the base member, including a first set interconnecting the base member to one side of the open mesh sheet through the spaced interstices thereof, and a second set of prongs projecting rearwardly of the back side and positioned to receive and secure a light socket with a decorative light bulb projecting through the open mesh sheet.

* * * * *